US006957015B2

(12) United States Patent
Pan et al.

(10) Patent No.: US 6,957,015 B2
(45) Date of Patent: Oct. 18, 2005

(54) LIQUID HEATING DEVICE

(76) Inventors: Huang Chuan Pan, P.O. Box 2-10, Tainan City (TW); Huang Chen-Lung, P.O. Box 2-10, Tainan City (TW)

( * ) Notice: Subject to any disclaimer, the term of this patent is extended or adjusted under 35 U.S.C. 154(b) by 0 days.

(21) Appl. No.: 10/643,112

(22) Filed: Aug. 15, 2003

(65) Prior Publication Data

US 2005/0207742 A1 Sep. 22, 2005

(51) Int. Cl.[7] ..... F24H 1/10
(52) U.S. Cl. ..... 392/478; 392/465
(58) Field of Search ..... 392/465, 468, 392/469, 478

(56) References Cited

U.S. PATENT DOCUMENTS 4,156,127 A * 5/1979 Sako et al. ..... 392/480
4,180,723 A * 12/1979 Szupillo ..... 219/541

* cited by examiner

*Primary Examiner*—Thor S. Campbell

(57) ABSTRACT

A liquid heating device includes a heater having its front and rear end respectively connected with two output terminals of a control circuit. When the control circuit is started, the heater will immediately generate high temperature to let the liquid inside heated up fast to a proper temperature, or boiled or converted into vapor, conforming to practicability.

2 Claims, 4 Drawing Sheets

LIQUID HEATING DEVICE

FIELD OF THE INVENTION

This invention relates to a liquid heating device, particularly to one relating to the structure of a patent application No. 91207475, titled "LIQUID VAPORIZING DEVICE" and another patent application No. 92202469, titled "LIQUID HEATING DEVICE", but newly designed, able to let the liquid inside quickly heated up to a proper temperature, or boiled or converted into vapor and applicable to drinking water machines or water heating systems or any equipment employed for liquid heating.

BACKGROUND OF THE INVENTION

For the present, a conventional liquid heating device is a cast block 1 made of an alloy of zinc with aluminum. The cast block 1 has an electric heating tube 10 (or an electric heating wire) of high impedance and a water duct 11 provided in the interior. After the electric heating tube 10 is electrified and generates high temperature, the cast block 1 will conduct the high temperature to the water duct 11 to let the liquid inside heated and converted into vapor.

By the conventional liquid heating device, the process of electrify the electric heating tube 10 to generate high temperature and then having the cast block 1 conducting the high temperature to let the liquid in the water duct 11 heated or gasified may take two or three to more than ten minutes, depending on the wattage of the electric heating tube 10. However, if liquid is heated to produce vapor within two or three minutes, an electric heating tube must be of large wattage, thus consuming too much electricity. On the contrary, if the electric heating tube is of small wattage and consumes only a little electricity, it may take ten to twenty minutes to heat up the liquid into vapor, thus taking too much time and resulting in much inconvenience.

Besides, the liquid in the water duct 11 is indirectly heated by the electric heating tube 10, therefore the heat energy produced is insufficient and the heating and vaporizing of the liquid become imperfect, still having drops of water remaining at the end of the water duct 11 and not conforming to practicability.

SUMMARY OF THE INVENTION

The objective of the invention is to offer a liquid heating device able to let liquid heated or vaporized quickly, conforming to utilization value of industry.

The features of the invention are as follows.

1. The liquid heating device is provided with a heater having its front and rear ends respectively connected with two output terminals of a control circuit. When the control circuit is started, the heater is electrified and generates high temperature to let the liquid inside heated, or boiled or vaporized.

2. The heater is provided with an insulating tube having a lengthwise through hole for liquid to flow therethrough. The insulating tube has its surface covered with an electric heating membrane having its front and rear end respectively provided with an electrode for connecting two output terminals of the control circuit.

BRIEF DESCRIPTION OF DRAWINGS

This invention will be better understood by referring to the accompanying drawings, wherein.

DETAILED DESCRIPTION OF THE INVENTION

Figure 1:
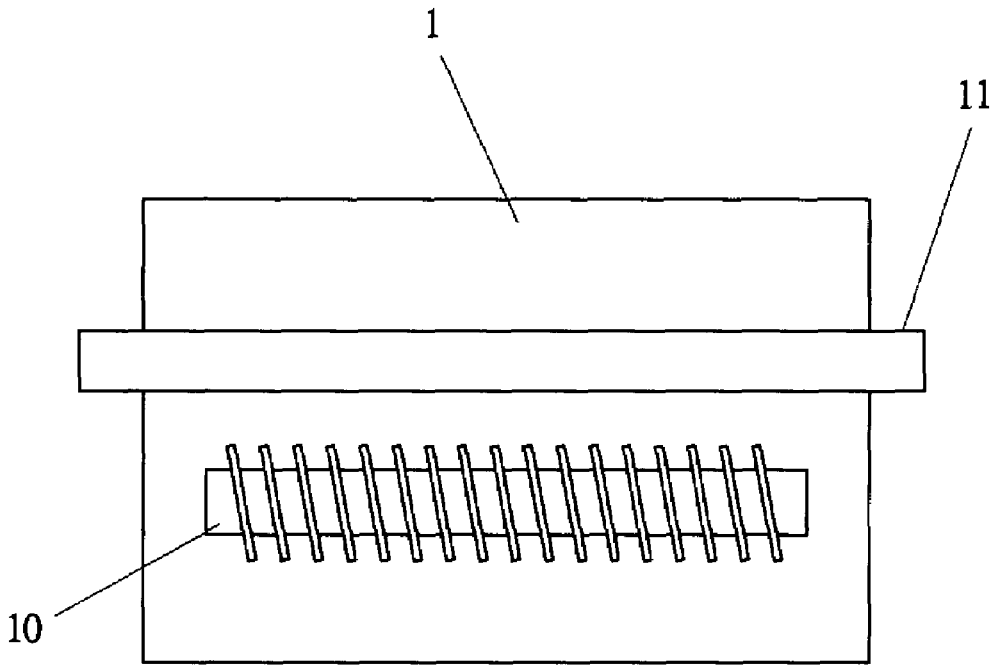
FIG 1 (PRIOR ART)
FIG. 1 is a front view of a conventional liquid heating device.
Figure 2:
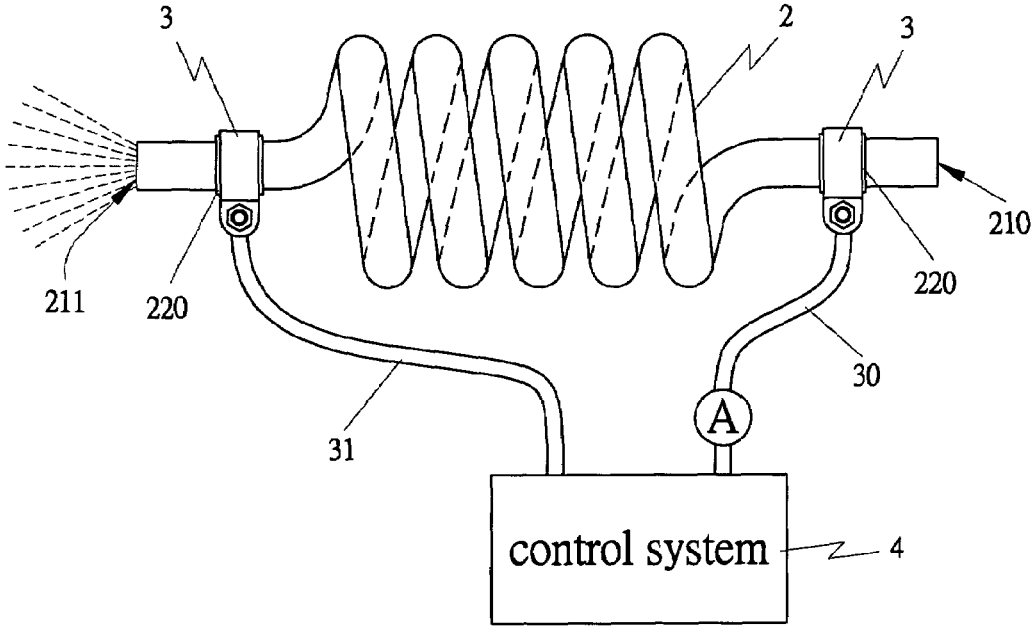
FIG. 2 is a cross-sectional view of a first embodiment of a liquid heating device in the present invention.
Figure 3:
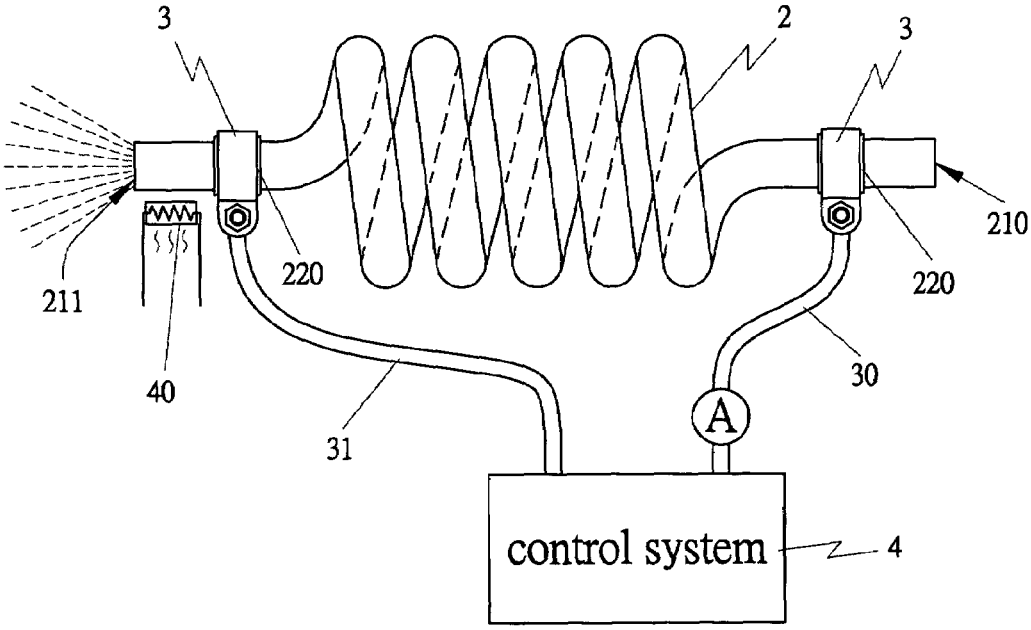
FIG. 3 is a cross-sectional view of a second embodiment of a liquid heating device in the present invention.
Figure 4:
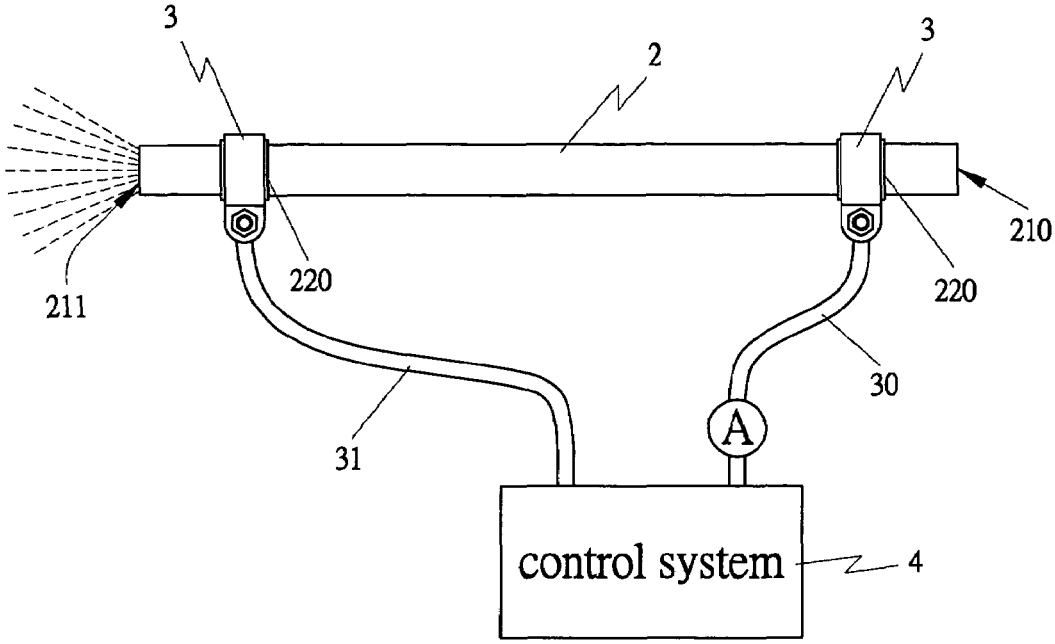
FIG. 4 is a cross-sectional view of a third embodiment of a liquid heating device in the present invention.
Figure 5:
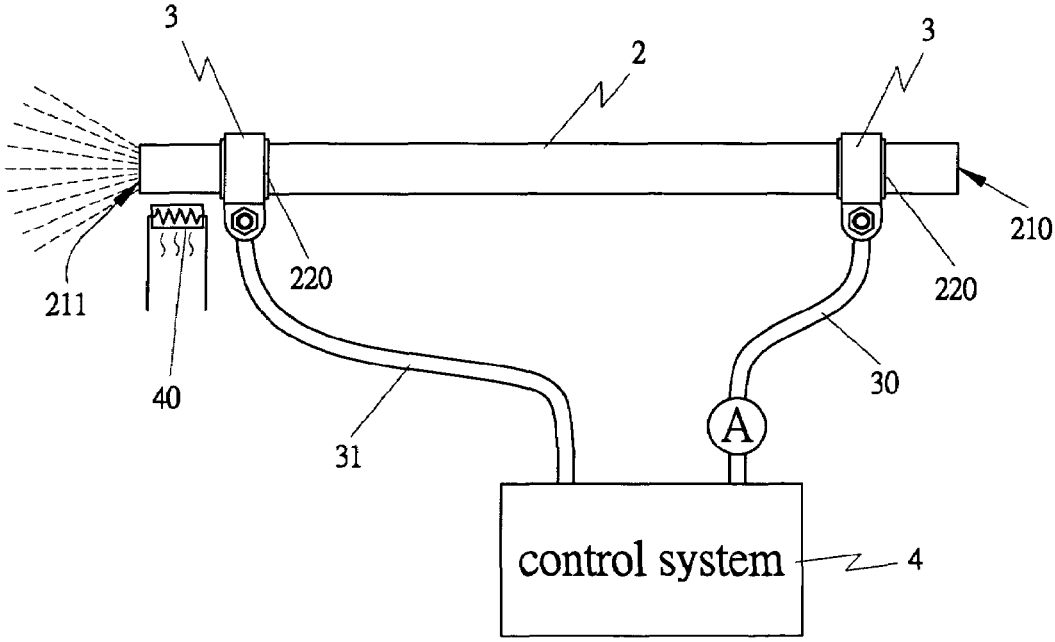
FIG. 5 is a cross-sectional view of a fourth embodiment of a liquid heating device in the present invention.
Figure 6:
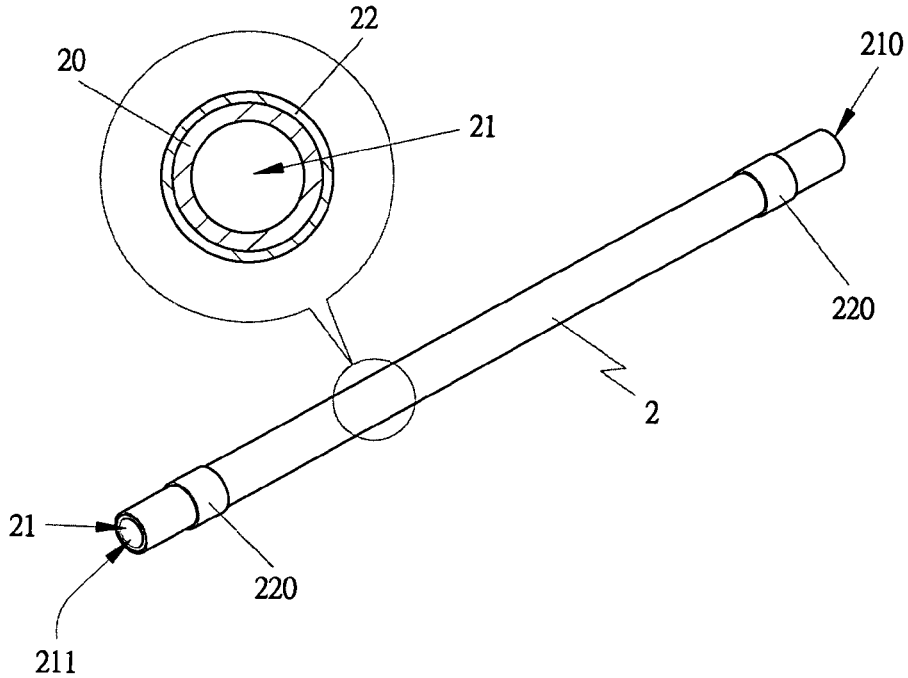
FIG. 6 is a perspective and a side cross-sectional view of the third embodiment of the heater of the liquid heating device in the present invention; and, FIG. 7 is a perspective view of the second embodiment of the heater of the liquid heating device in the present invention.
Figure 7:
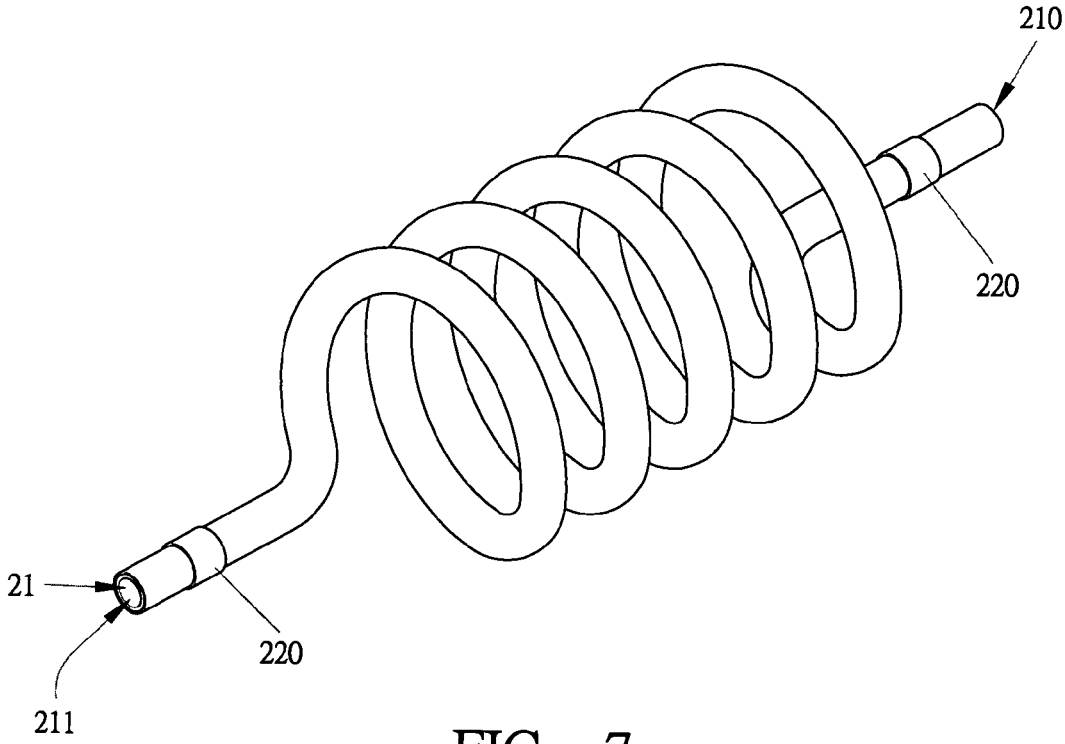

A first and a third preferred embodiment of a liquid heating device in the present invention, as shown in FIGS. 2 and 4, includes a heater 2 with a helical shape or a straight shape or any other shapes to meet various requirements, as shown in FIGS. 6 and 7. The heater 2 is provided with an insulating tube 20 made of an insulating material, such as quartz (the best) or other materials having the same property as quartz. The insulating tube 20 has a lengthwise through hole 21 for liquid to flow therethrough and has its outer surface covered with an electric heating membrane 22, which has its front and rear end respectively provided with an electrode 220 for a tube clamp 3 to clamp thereon. The lengthwise through hole 21 has an inlet 210 for liquid to flow in therethrough and an outlet 211 for boiling or heated liquid or vapor to exhaust therethrough. The two electrodes 220 are respectively clamped by the tube clamps 3, which are respectively connected with two conductive wires 30, 31, as shown in FIGS. 2 to 5. Thus, when the two conductive wires 30, 31 are electrified by the control circuit 4, the heater 2 can immediately generate high temperature to let the liquid inside heated or boiled or vaporized with quickness.

A second and a fourth preferred embodiment of a liquid heating device in the present invention, as shown in FIGS. 3 and 5, respectively have the same structure as that of the first and the third preferred embodiment, except that the heater 2 in the second and the fourth preferred embodiment has two temperature detectors 40 respectively installed at the outlet end for detecting the temperature of the heater 2, enabling the control circuit 4 to control the heater 2 with great accuracy.

Further, the heater 2 of the invention is made of an insulating material, so that the liquid inside can be quickly and directly heated by the heater 2, able to obtain an excellent heating efficiency. Furthermore, the heater 2 can be made into a straight shape or a helical shape or any other shapes so as to meet the requirements in use of various kinds of equipment. When liquid of normal temperature is conveyed into the heater 2 and flows therein, the liquid at the inlet 210 of the heater 2 has a lowest temperature, and the more inward the liquid flows, the higher temperature it has. This phenomenon is inevitable when liquid of a normal temperature flows in a tube. When the liquid flows to the outlet of the heater 2, it is vaporized or boiled or heated up to a proper temperature. The low temperature of the liquid at the inlet 210 of the heater 2 can prevent pressure inside the heater 2 from getting back and allow the liquid to flow therein smoothly. Thus, in case liquid is vaporized for use, it is impossible to produce drops of water and cause incomplete vaporization. If liquid is heated for use, it is able to let the liquid boiled or heated up to a proper temperature, therefore the liquid heating device of the invention can be extensively employed for drinking water machines or water heating systems or any equipment used for liquid heating, conforming to utilization value of industry.

While the preferred embodiments of the invention have been described above, it will be recognized and understood that various modifications may be made therein and the appended claims are intended to cover all such modifications that may fall within the spirit and scope of the invention.

What is claimed is:

1. A liquid heating device comprising a heater, said heater having an inlet for liquid to flow in therethrough and an outlet for boiled or heated liquid or vapor to flow out therethrough, said heater having an insulating tube made of quartz and a separate electric heating membrane covering an outer surface of the insulating tube, a front end and a rear end of said heating membrane being respectively clamped by a tube clamp, said tube clamps respectively connected with a conductive wire, said heater quickly generating high temperature by flowing electricity in said electric heating membrane between its front end and its rear end when said conductive wires are electrified by a control circuit, said heater making the liquid inside heated or boiled or vaporized quickly.

2. The liquid heating device as claimed in claim 1, wherein said heater has its outlet end provided with a temperature detector for detecting the temperature of said heater, so that said control circuit can control said heater with great accuracy.

* * * * *